United States Patent [19]

Chen

[11] Patent Number: 5,011,450

[45] Date of Patent: Apr. 30, 1991

[54] SOUND PRODUCING TOY WITH DRIVE MECHANISM FOR MOVABLE FIGURE

[76] Inventor: Francis Chen, P.O. Box 96-405, Taipei 10098, Taiwan

[21] Appl. No.: 502,794

[22] Filed: Apr. 2, 1990

[51] Int. Cl.[5] ..... A63H 5/00; A63H 13/04

[52] U.S. Cl. ..... 446/303; 446/358; 446/367; 40/418

[58] Field of Search ..... 446/362, 361, 359, 298, 446/303, 297, 358, 367; 40/414, 417–420; 84/95.2, 95.1

[56] References Cited

U.S. PATENT DOCUMENTS

| | | | |
|---|---|---|---|
| 2,065,965 | 12/1936 | Brown | 40/418 X |
| 2,254,091 | 8/1941 | Rossi | 40/420 X |

FOREIGN PATENT DOCUMENTS

| | | | |
|---|---|---|---|
| 411705 | 5/1945 | Italy | 446/362 |
| 666207 | 2/1952 | United Kingdom | 446/362 |
| 793223 | 4/1958 | United Kingdom | 446/298 |

*Primary Examiner*—Mickey Yu

[57] ABSTRACT

It is a toy transmission device, which includes a U-shaped frame being mounted with a spring motor. The spring motor is engaged with gear train and a shaft, on which a music code roller and a number of cam wheels are mounted. Each of the cam wheels is engaged with a cam lever for pulling a member of a toy. Whenever the spring motor is running, a music will be played while the toy makes various gestures as if playing the music.

4 Claims, 4 Drawing Sheets

SOUND PRODUCING TOY WITH DRIVE MECHANISM FOR MOVABLE FIGURE

BACKGROUND OF THE INVENTION

1. Field of the Invention

This invention relates to a motion doll, and particularly to a toy doll, of which the joints and limbs are to be pulled with a plurality of rigid pull wires that are connected with several cam levers respectively, and the cam levers are to be actuated with several corresponding cam wheels so as to have the doll looked as if playing a music instrument.

2. Description of the Prior Arts

In the conventional prior art of a motion doll, the joints of a doll are movable; when a person holds the body portion of the doll to swing, the joints of the doll would move simultaneously.

In another prior art, the joints of the limbs of a doll are movable, and each of the limbs is controlled with a pull string, of which the upper end is attached to a rod. When a person manipulates the rod, the doll will be pulled to show some desired gestures.

In the prior art, the swinging structure usually comprises several transmission mechanisms or lever structures to facilitate the movements of the joints or limbs of a doll; however, such a transmission mechanism or a lever structure can only provide a limited function or functions. Whenever the figure of a doll is changed or modified, such mechanism or structure would become useless.

SUMMARY OF THE INVENTION

The present invention relates to a toy transmission device, which mainly comprises a base and a movable doll. The joints of the doll are pivotally movable. A transmission structure is mounted inside the base. The bottom of each of the joints or limbs of the doll is connected with a rigid pull wire, of which the lower end is connected with a small hole on a corresponding cam lever. The bottom side of the cam lever is in contact with a corresponding cam wheel. All such cam wheels are pivotally mounted on a cam shaft; the cam shaft is engaged with a worm which is fixed on the shaft of a music code roller. When the music code roller rotates to produce a piece of music, the cam shaft will be driven to rotate; the cam wheels on the cam shaft will drive the corresponding cam levers to move up and down respectively so as to cause the limbs of the doll to move as if the doll plays a music instrument.

The prime object of the present invention is to provide a toy transmission device, in which a doll is installed on a base. The form of the doll may be designed into different form. The rotary parts or the joints of the doll are movable parts, and each of the movable parts is attached underneath with a rigid pull wire which is connected with a cam lever. When a cam lever is driven by a corresponding cam wheel, the corresponding limb of the doll will move or swing immediately.

Another object of the present invention is to provide a toy transmission device, in which a transmission structure disposed in the base includes a U-shaped frame being fixedly mounted therein. The flat board of the U-shaped frame is used for fixing a music bell; both side walls of the U-shaped frame are provided with a plurality of channels respectively, one end of each of the cam levers is pivotally mounted in a respective channel, the cam levers are movable up and down.

Still another object of the present invention is to provide a toy transmission device, in which the cam wheels are pivotally mounted on a cam shaft, of which one end is engaged with a worm on the shaft of the music code roller of a music bell. Each of the cam wheels has several projections having different lengths. When the music code roller rotates so that a plurality of music-spring strips all fit in order to play a piece of music, the cam shaft will be driven to rotate simultaneously to cause the cam wheels to actuate the cam levers to move up and down; in that case, the corresponding limbs of the doll will be pulled to move.

A further object of the present invention is to provide a toy transmission device, in which the cam wheels are mounted on a cam shaft. Each of the cam wheels is engaged with a cam lever, of which the bottom side has a bottom cam. One end of each of the cam levers is pivotally mounted, by a spindle, in a respective channel formed in both side walls of the U-shaped frame. Each of the cam levers is connected with a spring, of which the other end is attached to the corresponding side wall so as to have the cam lever always maintained in contact with the cam wheel. When the cam wheels rotate, the doll will swing and move immediately.

A still further object of the present invention is to provide a toy transmission device, in which each of the cam levers has several small holes for selectively attaching one rigid pull wire so as to pull a suitable part of the limb of a doll. When the cam wheels are driven to rotate, the limbs of the doll over the base will be pushed upwards immediately.

A yet still further object of the present invention is to provide a toy transmission device, in which the cam levers are pivotally mounted in parallel in the channels formed in both side walls of the U-shaped frame. One of the small holes on the cam lever is pivotally and selectively connected with a rigid pull wire so that the cam levers can to be used for smoothly swinging or moving different dolls.

DETAILED DESCRIPTION

Figure 1:
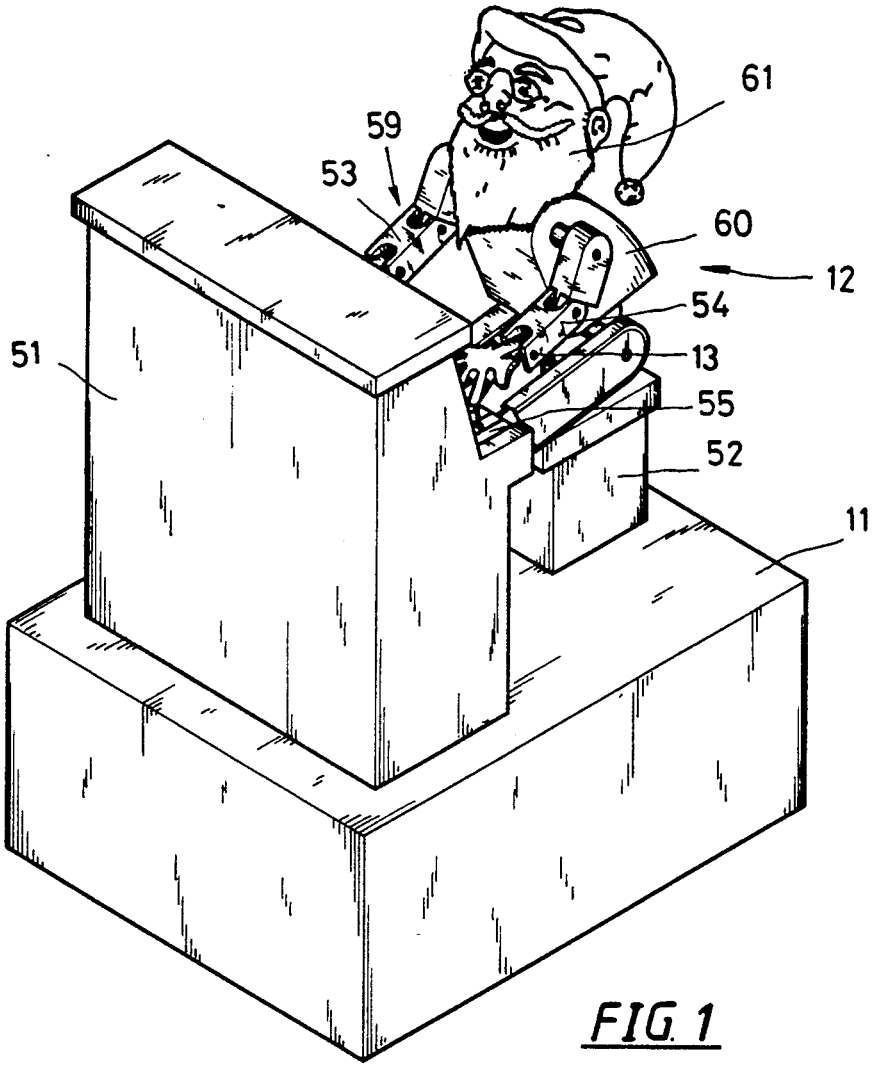
FIG. 1 is a perspective view of an embodiment according to the present invention.
Figure 7:
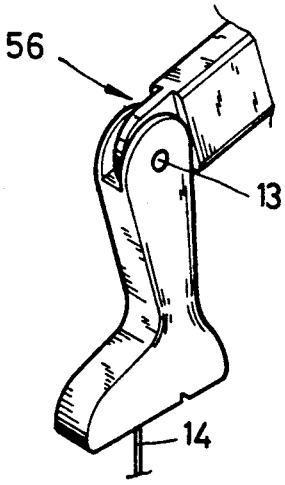
FIG. 7 is a perspective view of the joint part of the doll according to the present invention.
Figure 8:
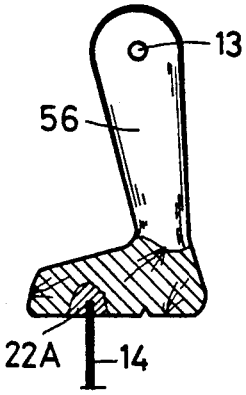
FIG. 8 is a sectional view of the connection part between the doll feet and the pull wire according to the present invention.
Figure 9:
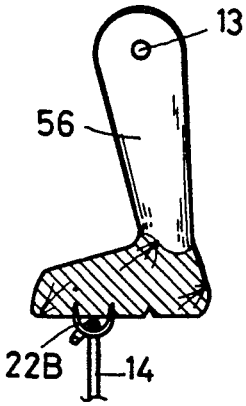
FIG. 9 is a sectional view of the connection part between the doll feet and the pull wire according to the present invention.

Referring to FIGS. 1 to 3 and 5, the present invention provides a toy transmission device, which mainly comprises a base 11 and a doll 12. The base 11 is mounted with a transmission device, which includes a U-shaped frame 25, a music bell 19, a plurality of transmission cam wheels 17, cam levers 15, rigid pull wires 14, and springs 28. The music bell 19 is fixedly attached to a flat board 40 of the U-shaped frame 25, of which both side walls 26 are provided with a plurality of channels 33 respectively for movably receiving the cam levers 15 respectively. The joints and the rotary parts of the doll mounted on the base 11 are all movable parts. Each of the joints or rotary parts is connected with a rigid pull wire 14 thereunder, while the other end of the rigid pull wire is pivotally attached to a small hole 16 formed in the cam lever 15. The bottom side of the cam lever 15 is movably engaged with a transmission cam wheel 17; all the cam wheels 17 are mounted on a cam shaft 18. One end of the cam shaft 18 is connected with the worm 21 which is fixed on the shaft of the music code roller 20 of the music bell 19. When the music bell 19 plays musical sounds, a similar and corresponding motion will be transmitted to the cam shaft 18 through the shaft of the music code roller to cause the transmission cam wheels 17 to drive the cam levers 15 respectively in order that the cam levers 15 are caused to move up and down at different time so as to actuate the doll 12 to make various gestures as if playing the music.

In fact, the doll 12 may be designed into different figures; for instance, the doll 12 according to the present invention looks like an Santa Claus playing a piano. The doll in the present invention may be designed with various motions and gestures. In the present invention, a dummy piano 51 is placed in front of the Santa Claus; the Santa Claus is sitting on a chair 52 behind the piano with his two hands 55 and 54 placed on the piano keys 55, and with his two legs 56 and 57 put on the foot keys 58. The arms 59, the two legs 56 and 57, and the body portion 60 of the doll 12 can perform regular and rhythmic motions corresponding to the music of the music bell as if the Santa Claus really plays a piano.

As shown in FIGS. 2 to 4, 6 to 9, the joints or the rotary parts 13 of the doll 12 are pivotally connected with their related parts respectively; for instance, the arms 59 and the legs 56 and 57 are pivotally connected with the body portion 60 by means of a spindle 13; the body portion 60 and the head 61 are connected together by means of a spring so as to have the various parts move or swing freely.

After all the movable parts of the doll are assembled in place, the doll is mounted on a base 11. Each of the movable parts of the doll is connected underneath with a rigid pull wire 14, which is fixed in place with a small nail 22B or a glue 22A. The rigid wires 14 penetrate through various round holes 23 formed in the base 11 respectively; the lower ends of the rigid wires 14 are connected with the small holes 16 on the cam levers 15 respectively. When one of the cam levers 15 is moved up and down, the rigid pull wire 14 which is connected to the cam lever will pull or push the corresponding parts to move immediately.

Figure 2:
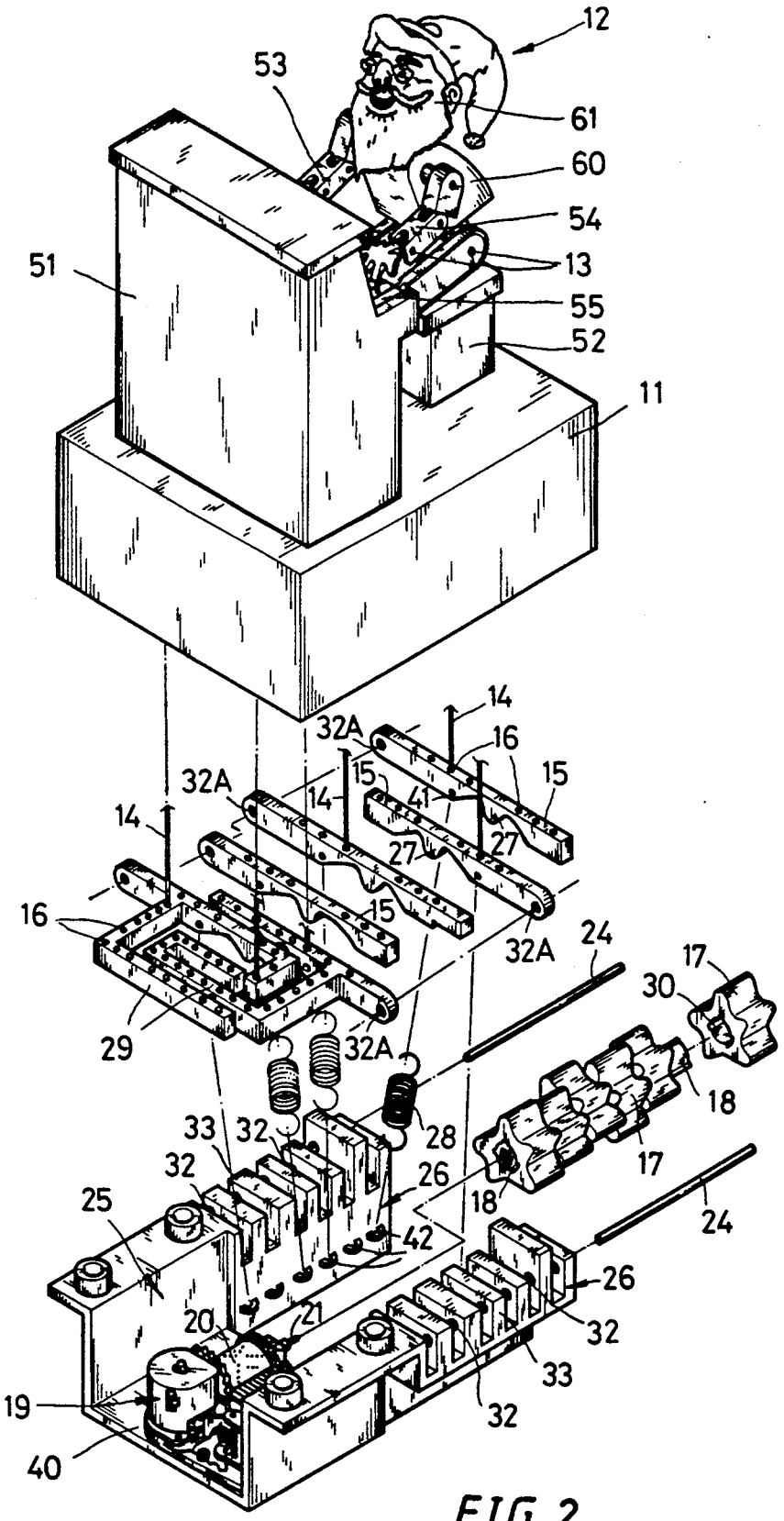
FIG. 2 is a disassembled view of the present invention.
Figure 3:
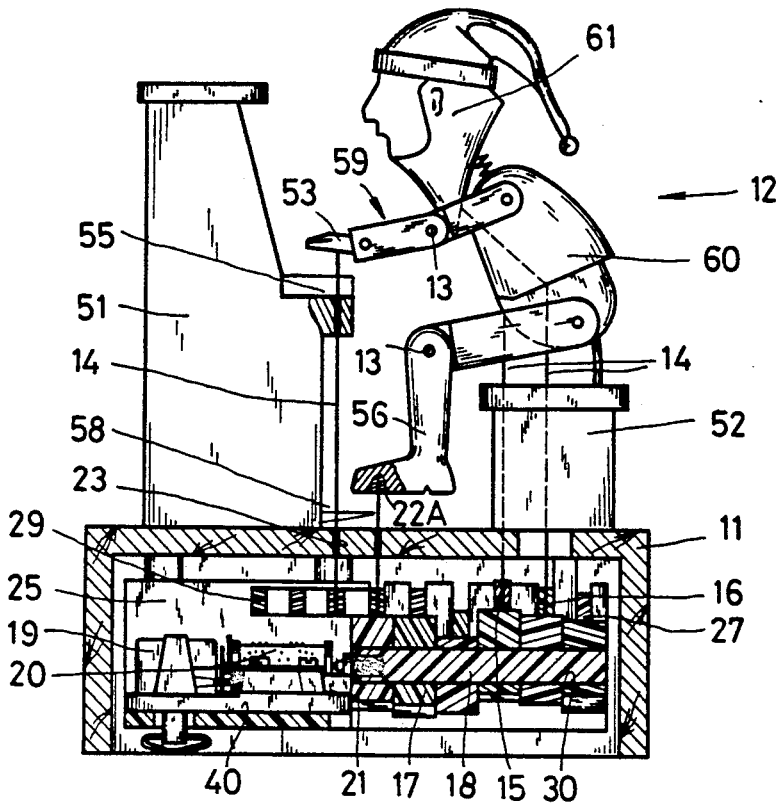
FIG. 3 is a cross section view of the present invention, showing the related position of the parts to be actuated.
Figure 4:
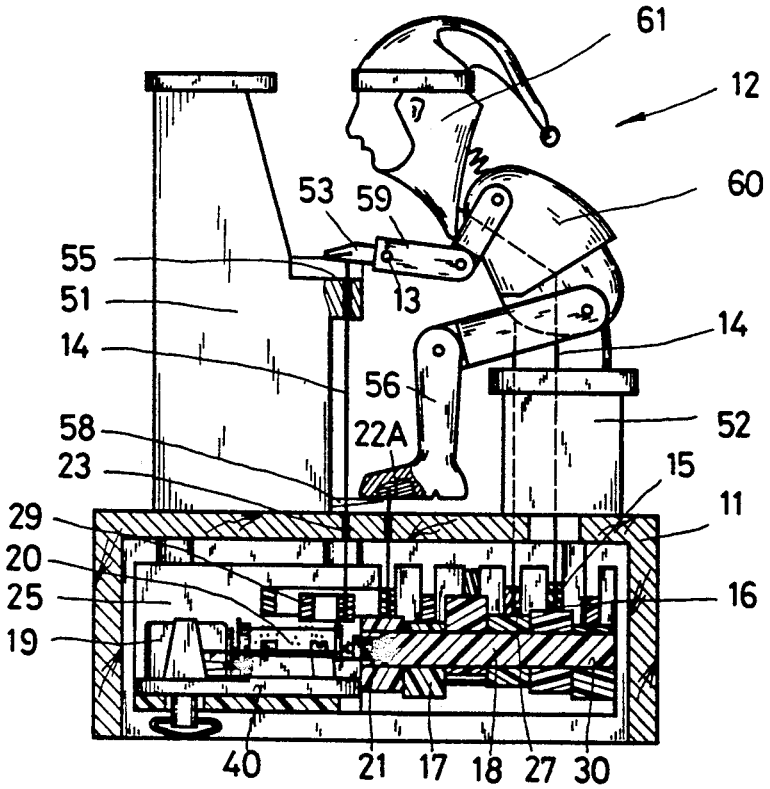
FIG. 4 is a cross section view of the present invention, showing the changed position of various parts upon being actuated.
Figure 5:
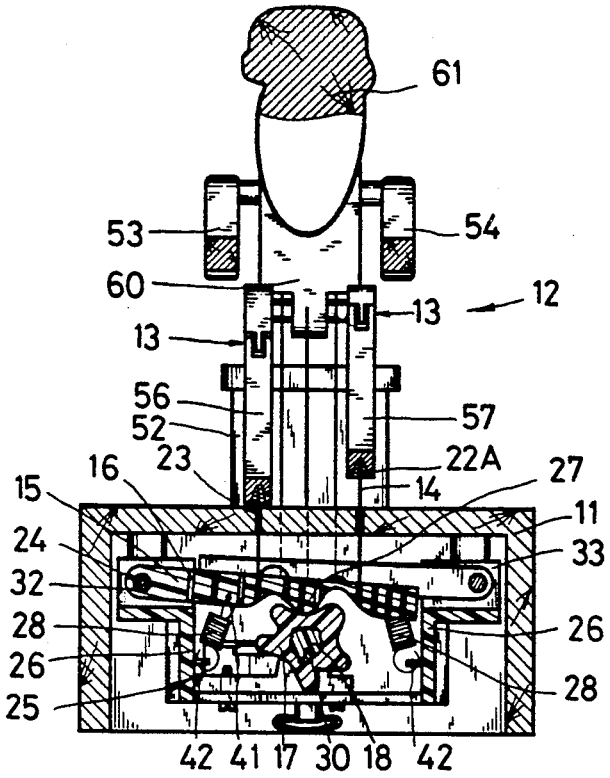
FIG. 5 is a vertical section view of-the present invention, showing the related position of the parts to be actuated.
Figure 6:
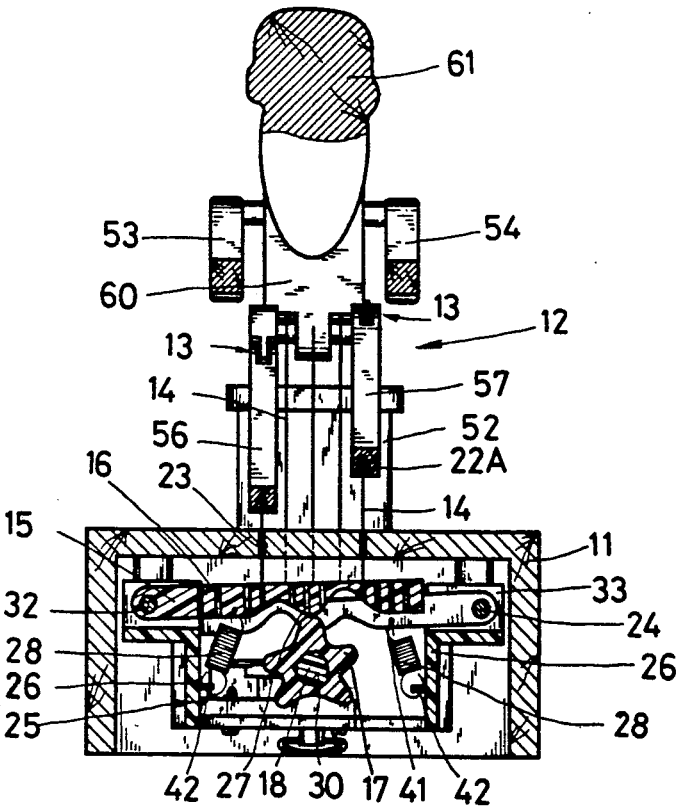
FIG. 6 is a vertical section view of the present invention, showing the changed position of various parts upon being actuated.

After the joints or the rotary parts 13 are connected with the rigid pull wires 14 respectively, the wires pass through the round holes 23 respectively, and then are fixed in the small holes 16 on the cam levers 15 respectively. The transmission relation between the cam lever 15 and the doll 12 is shown in FIG. 2, in which a round hole 32A is provided at one end of the cam lever 15; the end of the cam lever 15 with a round hole 32A is pivotally mounted with a spindle 24 in a channel 33 at one of the side walls 26. The cam lever 15 is provided with several holes 16 to be connected with the rigid pull wire 14, the bottom side of the cam lever is furnished with a bottom cam 27 at a suitable position to be engaged with a transmission cam wheel 17. A spring 28 is connected between the cam lever 15 and the side wall 26; one end of the spring 28 is connected with the small round hole 41 of a cam lever, while the other end thereof is connected with a ring 42 on one side of the side wall 26 so that the cam lever 15 is biased to closely contact with a corresponding transmission cam wheel 17. In order to let the movable parts mounted over the music bell 19 and the base 11 move or swing freely, some of cam levers 15 are provided with extended parts 29 respectively, which are also furnished with small holes 16 for attaching the corresponding rigid pull wires 14 respectively.

One end of the cam lever 15 is pivotally mounted on a spindle 24, and the bottom cam 27 of the cam lever is engaged with a corresponding cam wheel 17, which has a plurality of projections. The cam wheels are mounted in parallel on a cam shaft 18 through the cam wheel holes 30 thereof respectively. The engaged position between a cam wheel 17 and a corresponding cam lever 15 is to be determined in accordance with the position of a swinging parts of the doll 12. In order to have the cam wheel 17 and the cam lever 15 maintained in contact condition in the lowest part of the cam lever, a pull spring 28 is mounted between the side wall 26 and the cam lever 15.

After the various transmission cam wheels 17 are mounted on a cam shaft 18, one end of the cam shaft 18 is mounted with a sunk nut, whereby the cam shaft 18 is connected with the outer end of the worm 21 of the music code roller 20; when such a connection is made, the cam shaft 18 will rotate upon the music code roller rotating and playing a music. As a result, the cam wheel 17 on the cam shaft will rotate to actuate a corresponding cam lever to move upwards and to push a rigid pull wire 14 upwards, whereby a corresponding joint or rotary part of the doll will be cause to move or swing simultaneously in accordance with the music rhythm; in that case, it looks as if a Santa Claus plays a piano.

Briefly, the transmission structure of the present invention is to be assembled by following the aforesaid description, but the player or the figure outside the device may be varied for obtaining the best amuzement result. It is deemed that the present invention is a novel and pratical disclosure in terms of its structure, i.e., the joints of the doll are connected with the rigid pull wires respectively; the rigid pull wires are then connected with the small holes on the cam levers respectively; the cam levers are contiguous to the corresponding transmission cam wheels respectively; and the cam shaft is pivotally connected with the worm of the music code roller; when the music code roller rotates, the cam levers will, through the rigid pull wires, actuate the joints or rotary parts of the doll to make various swinging movements as amuzement and decoration features.

I claim:

1. A toy combination comprising a base, a doll disposed upon said base, said doll including a plurality of movable parts, and a transmission device provided for manipulating a movement of said doll; said transmission device comprising:

a U-shaped frame being fixed on said base, a flat board being formed on a bottom of said U-shaped frame, a plurality of channels being formed on both side walls of said U-shaped frame;

a music bell being fixed on said flat board of said U-shaped frame, said music bell having a music code roller;

a cam shaft being coupled to said music code roller and being rotated in concert with said music code roller;

a plurality of cam wheels being disposed on said cam shaft;

a cam lever being provided upon each of said cam wheels, one end of each of said cam levers being received within a respective channel formed on said side walls of said U-shaped frame and being pivotally coupled therein, a plurality of holes being formed in an upper surface of each of said cam levers, a lower surface of each of said cam levers contacting with a respective cam wheel;

a plurality of rigid pull wires, one end of each of said rigid pull wires being connected with one of said movable parts of said doll, and the other end being connected with one of said holes formed on said upper surface of a respective cam lever; and a plurality of springs, one end of each of said springs being connected with one of said cam levers, and the other end being coupled to a respective side wall of said Ushaped frame so that said cam levers are biased downward and so that said lower surfaces of said cam levers are biased to contact with said cam wheels; and when said music code roller rotates, said cam shaft and said cam wheels being caused to rotate so that said cam levers are caused to move up and down by an engagement between said cam levers and said cam wheels, and so that said movable parts of said doll are caused to move up and down by said rigid pull wires.

2. A toy combination according to claim 1, wherein a spindle passes through said channels formed on a respective side wall of said U-shaped frame, said one end of each of said cam levers, is pivotally coupled to said side wall by a respective spindle so that said cam levers are caused to rotate about said spindles by said engagement between said cam levers and said cam wheels.

3. A toy combination according to claim 2, wherein a cam portion is formed in said lower surface of each of said cam levers and contacts a respective cam wheel so that said cam levers are caused to rotate about said spindles by an engagement between said cam portions of said cam levers and said cam wheels.

4. A toy combination according to claim 1, wherein a worm is fixed on a free end of said music code roller, one end of said cam shaft is coupled to said worm so that said cam shaft rotates in concert with said music code roller.

* * * * *